US006367441B1

(12) United States Patent
Hoshiba et al.

(10) Patent No.: US 6,367,441 B1
(45) Date of Patent: Apr. 9, 2002

(54) LUBRICATING SYSTEM FOR FOUR-CYCLE OUTBOARD MOTOR

(75) Inventors: Akihoko Hoshiba; Takahide Watanabe, both of Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/290,496

(22) Filed: Apr. 12, 1999

(30) Foreign Application Priority Data

Apr. 16, 1998 (JP) ..... 10-105262

(51) Int. Cl.[7] ..... F01M 1/00
(52) U.S. Cl. ..... 123/196 R
(58) Field of Search ..... 123/96 R; 440/88

(56) References Cited

U.S. PATENT DOCUMENTS 4,523,556 A * 6/1985 Suzuki ..... 123/196 R
4,562,797 A * 1/1986 Suzuki ..... 123/196 R
4,828,519 A * 5/1989 Watanabe ..... 440/88
5,514,015 A * 5/1996 Okazawa et al. ..... 440/88
5,704,819 A * 1/1998 Isogawa ..... 440/88

* cited by examiner

*Primary Examiner*—Willis R. Wolfe
*Assistant Examiner*—Jason A Benton
(74) *Attorney, Agent, or Firm*—Knobbe, Martens, Olson & Bear, LLP

(57) ABSTRACT

A four-cycle outboard motor has a lubricating system designed with external gas transfer pipes. Additionally, an internal gas transfer passageway is arranged to encourage the gases contained within the lubrication pan to be expelled through the secondary passageways without substantially blocking a lubrication return line from a camshaft chamber or a crankshaft chamber. The outboard motor features an inline vertically oriented cylinder bank, such that oil introduced at an upper region and drains back to a lubrication pan through the lubrication return passageways arranged at a lower portion of the camshaft chamber and the crankshaft chamber.

19 Claims, 7 Drawing Sheets

LUBRICATING SYSTEM FOR FOUR-CYCLE OUTBOARD MOTOR

BACKGROUND OF THE INVENTION

1. Field of the Invention

The present invention relates to an internal combustion engine. More particularly, the present invention relates to a lubrication system for a four-cycle vertically-oriented engine.

2. Description of the Related Art

Internal combustion engines operating on a four-cycle principle may be provided with a pressure lubricating system for lubricating various engine components. Internal combustion engines that are used to power watercraft featuring outboard motors are commonly vertically oriented within a cowling of the motor. In this arrangement, each piston reciprocates along a generally horizontal axis. Also, a crankshaft and each camshaft typically rotates about a substantially vertical axis.

In such arrangements, lubricating the shafts poses a number of problems specific to vertically-oriented watercraft engines. For instance, due to the vertical arrangement of the shafts, lubricant must be supplied at an upper point of each shaft such that it can drain downward to lubricate the shaft and each of the bearings along its length. The lubricant would then pool within a bottom portion of each chamber housing a shaft. To facilitate recirculation and avoid flood the chambers with lubricant, the bottom of each chamber would be connected to a lubricant reservoir or pan by a single passage. The lubricant pooling at the bottom of the chamber could then drain into the lubricant pan through this passage.

Because the lubricant pan was not sealed from a bottom side of the pistons and the cylinders, exhaust gases that blow-by the piston during the exhaust stroke of the engine would frequently pass into the lubricant pan. A difficulty arose when blow-by gases accumulating inside the oil pan streamed through the drain passages against the flow of the draining lubricant. The collision between the draining lubricant and the blow-by gases inhibited a smooth flow of the lubricant out of the chambers. Frequently, the inhibition of lubricant flow caused flooding of the chambers and excessive entrainment of lubricant within the blow-by gases.

One method envisioned to solve this problem involved enlarging a cross-sectional area of the passage such that both the blow-by gases and the lubricant could flow uninhibited. However, in order to accommodate such an enlarged passage, the cylinder block containing the enlarged passage had to be enlarged as well. Such an enlargement disadvantageously increases the weight of the outboard motor. Alternatively, two separate passages were formed within the cylinder block such that lubricant may pass through one passage while blow-by gases could pass through the other. However, this arrangement also results in disadvantageously increasing the cylinder block size to accommodate the internal passageways. Moreover, expenses associated with manufacturing the cylinder block increased due to the increase in cylinder block geometry.

SUMMARY OF THE INVENTION

Accordingly, an efficient and cost-effective method of venting the blow-by gases from the lubrication pan is desired. Additionally, a structure enabling the blow-by gases to be effectively separated from the lubricant is also desired which does not result in an increased engine size.

According to one aspect of the invention an outboard motor has a four-cycle engine. The engine includes a cylinder block having at least one cylinder. The cylinder preferably has a substantially horizontal axis. A piston is arranged for reciprocation within the cylinder and is connected to an output shaft. The output shaft preferably has a substantially vertical axis. The engine also includes a head assembly connected to the cylinder block. Moreover, the engine further comprises at least one combustion chamber that is defined between the head assembly and a piston. There are at least one intake port and at least one exhaust port arranged to communicate with the combustion chamber. The engine also has an intake valve capable of closing and opening the intake port and an exhaust valve capable of closing and opening the exhaust port. An intake cam shaft is configured to be capable of moving the intake valves while an exhaust cam shaft is configured to be capable of moving the exhaust valves. The engine also has a head cover positioned over the intake cam shaft and the exhaust cam shaft to defining, in part, a cam chamber. The engine has a lubrication reservoir arranged generally below a lower end of the cylinder block. A lubricant return passageway preferably extends between the cam chamber and the lubrication reservoir while a separate gas passageway also connects the lubrication reservoir and the cam chamber. Preferably at least a portion of the gas passageway includes a gas pipe positioned external to the engine.

According to another aspect of the present invention, an outboard motor generally comprises an engine. The engine includes a generally vertically-oriented camshaft that is contained within a camshaft chamber. The engine also has a lubricant reservoir with a lubricant pump arranged to pump lubricant from the lubricant reservoir to at least one location proximate the camshaft. A lubricant return passage extends between a lower portion of the camshaft chamber and the lubricant reservoir while a gas passage extends between the lubricant reservoir and the camshaft chamber. The gas passage preferably enters the camshaft chamber at a location that is vertically higher than an opening in the camshaft chamber leading to the lubricant return passage and preferably at least a portion of the gas passage is external to the engine.

BRIEF DESCRIPTION OF THE DRAWINGS

These and other features, aspects and advantages of the present invention will now be described with reference to the drawings of a presently preferred embodiment, which embodiment is intended to illustrate and not to limit the invention, and in which figures.

DETAILED DESCRIPTION OF THE PREFERRED EMBODIMENT

Figure 1:
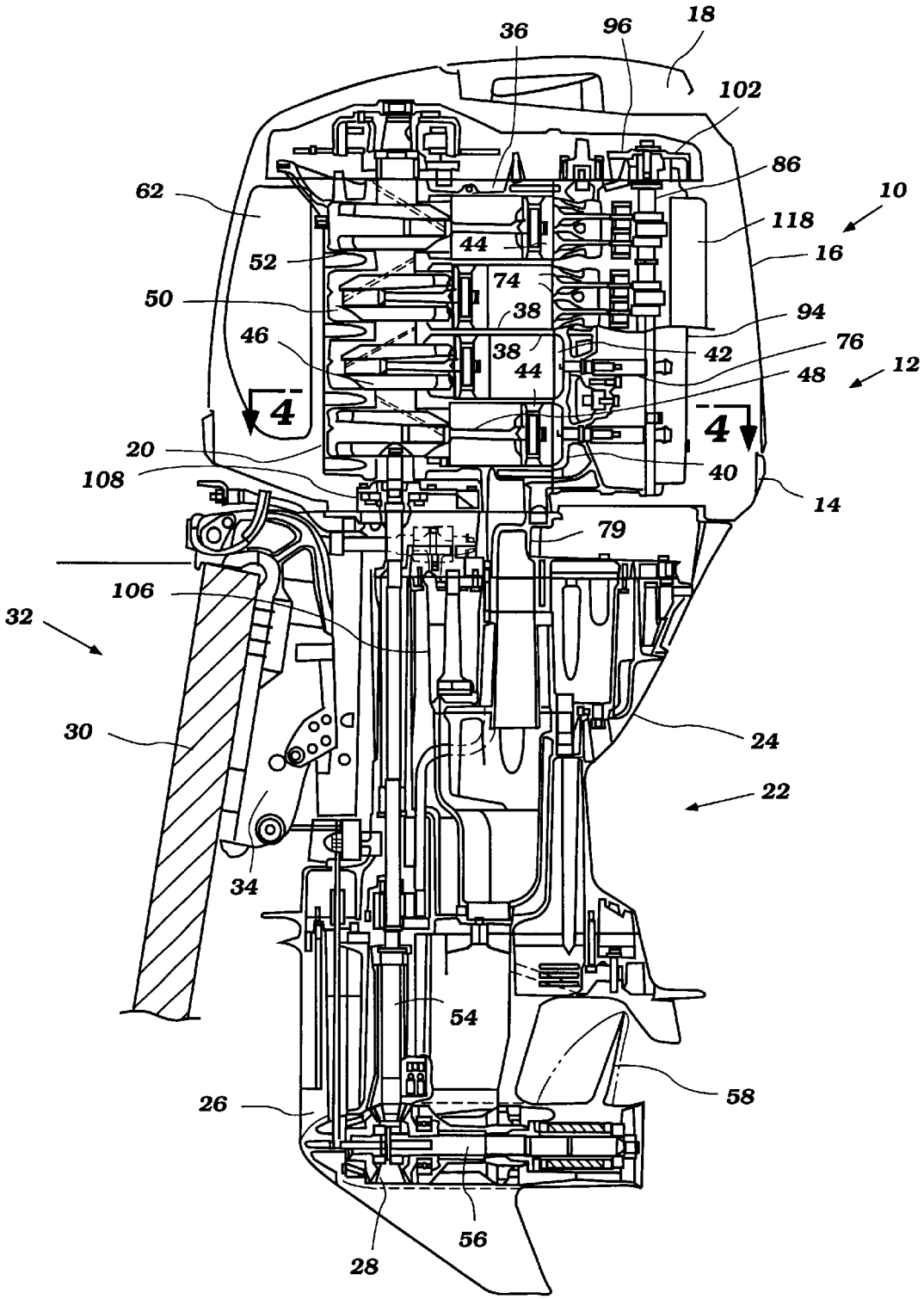
FIG. 1 is a partially-sectioned side view of an outboard motor of the type which may be powered by an engine having a lubrication system configured and arranged in accordance with certain aspects of the present invention.

With initial reference to FIG. 1, an outboard motor having a lubrication system configured and arranged in accordance with certain features, aspects and advantages of the present invention is illustrated therein. The outboard motor is indicated generally by the reference numeral 10. While the present lubrication system is described in the context of an outboard motor for watercraft, it should be appreciated that the lubrication system may also find utility in other internal combustion engine applications having at least one substantially-inclined or vertically oriented shaft requiring lubrication.

The illustrated outboard motor 10 has a power head area 12 comprised of a lower tray portion 14 and an upper cowling portion 16. The lower tray portion 14 and the upper cowling portion 16 may be joined in a well known manner such that the power head area 12 is substantially weatherproof and water spray resistant. For instance, a rubber seal (not shown) may be positioned in the joining region. An air vent or air inlet area 18 is provided in the illustrated upper cowling portion 16 for providing air to an engine 20 that is desirably arranged and encased within the power head area 12. The air vent 18 also allow heated air to be exhausted from within the power head area 12.

With continued reference to FIG. 1, the illustrated outboard motor 10 also includes a lower unit 22 extending downwardly from the lower tray portion 14 of the power head area 12. The lower unit 22 generally comprises an upper or drive shaft housing portion 24 and a lower portion 26 which contains a transmission 28 and carries a propulsion mechanism described below.

The illustrated outboard motor is generally attached to a transom 30 of a watercraft 32 by a bracket 34 as is well known in the art. This bracket 34 preferably enables both steering and tilt and trim such that the outboard motor 10 may be steered about a substantially vertical axis and tilted or trimmed about a substantially horizontal axis in manners well known to those skilled in the art.

With continued reference to FIG. 1, the engine 20 may be of any configuration which is substantially inclined such that an axis of at least one camshaft or crankshaft has an inclined or substantially vertical axis. For instance, the engine may contain as few as one cylinder or more than two cylinders. In the illustrated embodiment, the engine comprises four inline cylinders. The engine 20 may also operate on any known operating principle. The illustrated engine preferably operates on a four-cycle principle.

Accordingly, the illustrated engine 20 generally comprises a cylinder block 36 that contains four inline cylinders 38 which are closed by a cylinder head assembly 40 to create a combustion chamber 42 above a piston 44 within each of the cylinders 38. The piston 44 is arranged for reciprocation within the cylinder 38 and connected to a crankshaft 46 via connecting rods 48 in a known manner. Each of these elements are well known by those of skill in the art and their manufacturing and assembly methods are also well known.

The crankshaft 46 is preferably rotatably journaled within a crankcase chamber 50. The illustrated crankshaft chamber 50 is defined in part by a crankcase cover 52. As is typical with outboard motor practice, the engine 20 is preferably mounted in the power head 12 so that the crankshaft 46 rotates about a substantially vertically extending axis. This positioning facilitates coupling to a driveshaft 54 in any suitable manner.

The driveshaft 54 depends into the lower unit 22 wherein it drives a bevelled gear in conventional forward, neutral, reverse transmission 28. Any known type of transmission may be employed. Moreover, a control is preferably provided for allowing an operator to remotely control the transmission 28 from within the watercraft 32.

The transmission 28 desirably drives a propeller shaft 56 which is rotatably journaled within the lower portion 26 of the lower unit 22 in a known manner. A hub of a propeller 58 is coupled to the propeller shaft 56 for providing a propulsive force to the watercraft 32 in a manner also well known to those of ordinary skill in the art.

Figure 2:
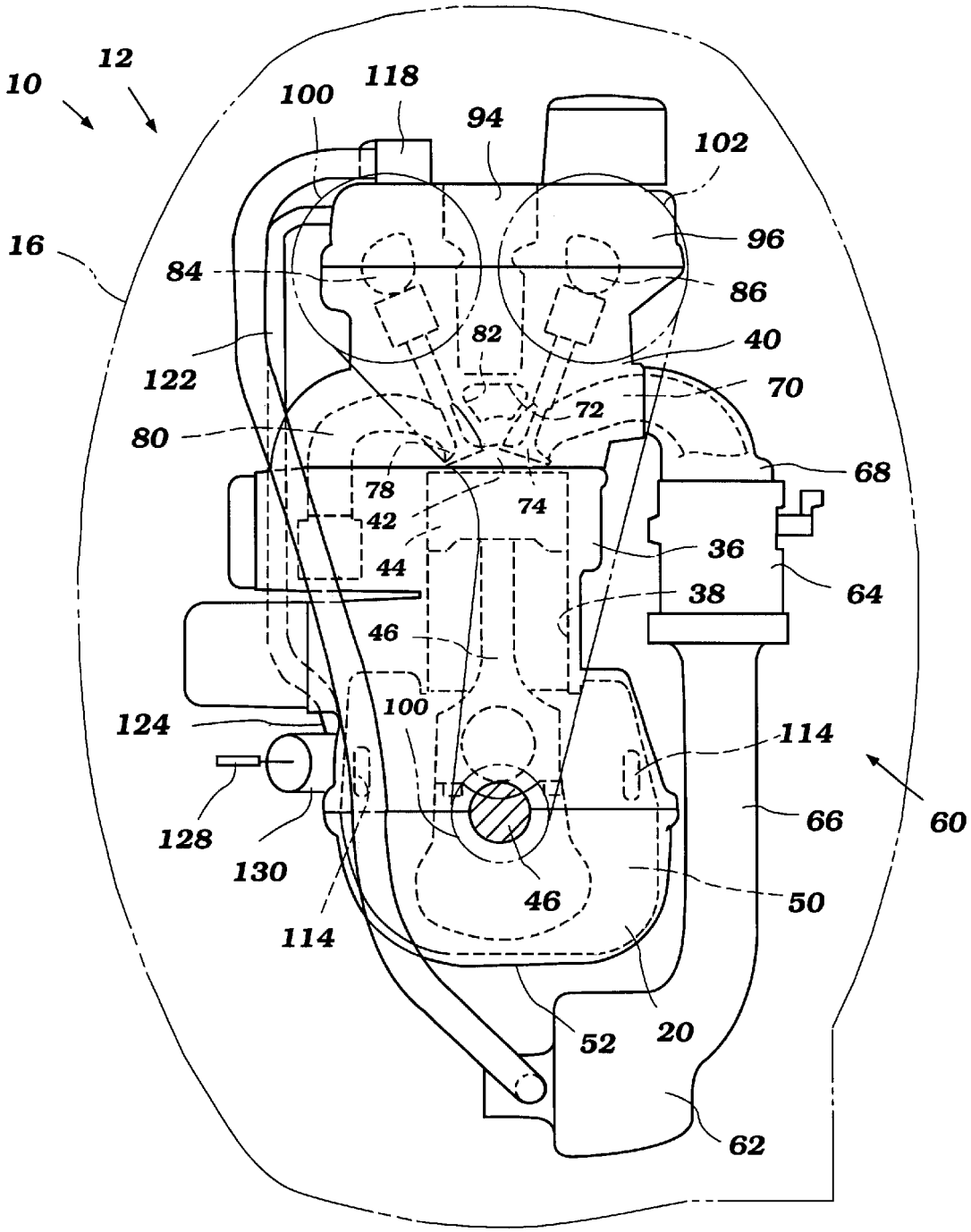
FIG. 2 is a top view of the outboard motor of FIG. 1 with certain components illustrated with phantom lines and certain other components illustrated with hidden lines.

With reference now to FIG. 2, the illustrated engine 20 is provided with an intake system 60. The intake system 60 transfers air from outside of the outboard motor upper cowling 16 to the combustion chambers 42. Specifically, the air from outside of the upper cowling 16 is drawn into the cowling through the air vent 18. This air is then pulled into a silencer 62 through an intake opening 63. The intake opening 63 may be provided with a filter or grate such that airborne particles can be filtered from the air prior to introduction into the engine 20.

The air is then transferred from the silencer 62 to a carburetor 64 through an intake pipe 66. As illustrated in FIG. 2, the intake pipe 66 wraps around the side of the engine 20 and extends rearward toward the carburetor 64. While the illustrated engine 20 is a carbureted engine, it is anticipated that the present invention may also have utility with a fuel-injected engine of either the direct injection or indirect injection type. Fuel is introduced to the airflow of the induction system 60 within the carburetor 64 in a known manner. Moreover, a throttle valve is typically positioned within or immediately adjacent the carburetor 64 for controlling the rate of airflow into the combustion chamber through the intake system 60.

The air flows from the carburetor 64 into an intake manifold 68. The illustrated intake manifold 68 generally comprises a plurality of runners such that each cylinder is supplied with an air/fuel charge through an individual runner. The air continues from each runner of the illustrated intake manifold 68 through a corresponding intake passage 70 through which the air is introduced into the combustion chamber 44 in a known manner. The intake passage 70 joins with the combustion chamber 44 at an intake port 72 also in a known manner.

The introduction of the air fuel charge into the combustion chamber 44 is controlled by an intake control valve 74 such that the timing and duration of the induction of the air fuel charge may be controlled as desired. The intake control valve 74 is actuated in a manner to be described below.

Upon introduction into the combustion chamber, during an intake stroke of the piston 44, the intake control valve 74 generally closes as soon as or just before the piston 44 begins its compression stroke. The compressed air fuel charge is then ignited by a spark plug 76 which has an electrode positioned within the combustion chamber region for igniting the air fuel charge.

Figure 3:
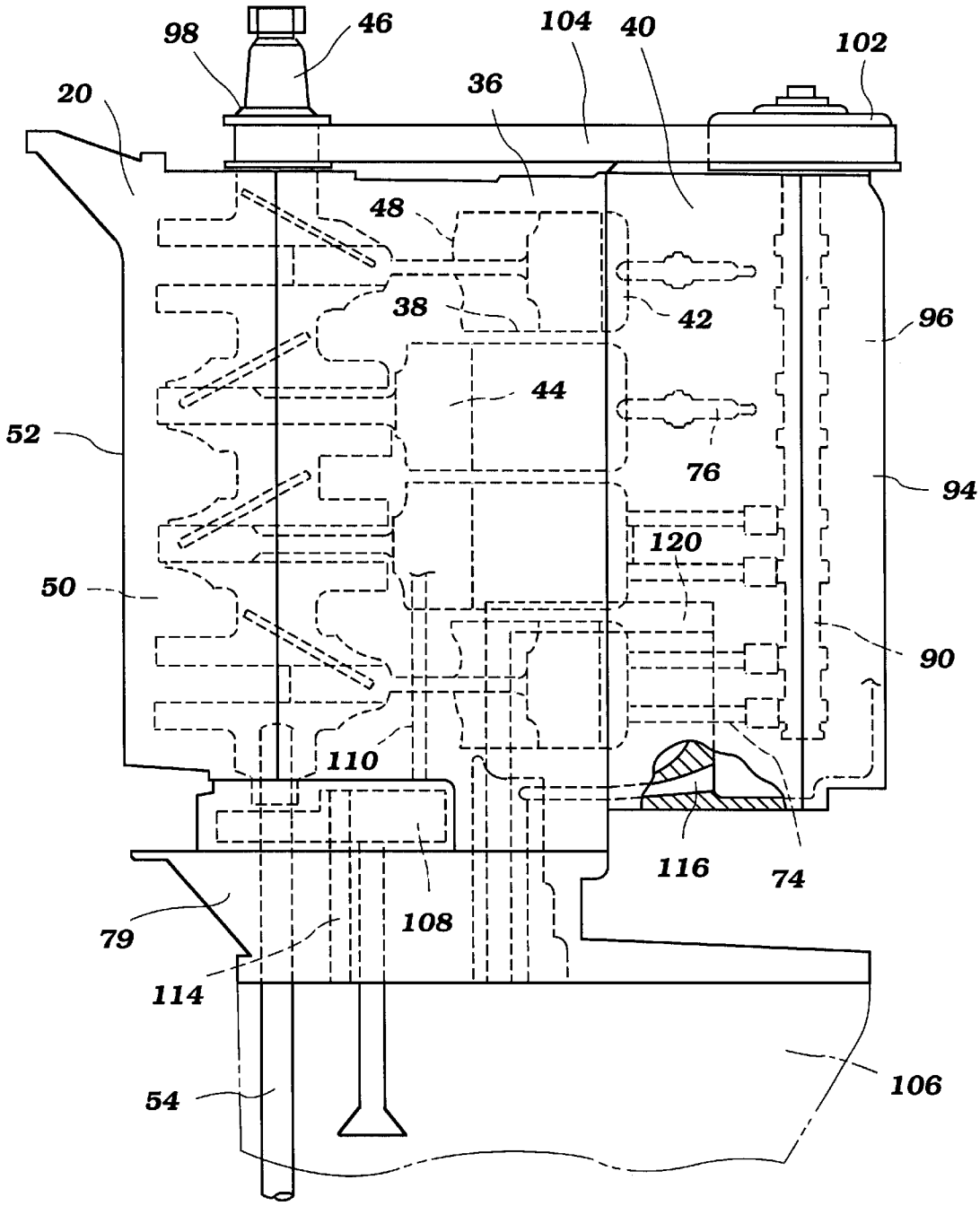
FIG. 3 is a partially-sectioned side view of a portion of the outboard motor of FIG. 1 illustrating a portion of a lubrication system configured and arranged in accordance with certain aspects of the present invention.

An exhaust system is provided for routing the products of the combustion within the combustion chamber 42 to a point external to the engine 20. In particular, the exhaust gases pass through an exhaust port 78 in the combustion chamber 42 and are routed via an exhaust passage 80 to an exhaust manifold. In the illustrated engine, an exhaust guide plate 79 is positioned below the cylinder block 36 as best shown in FIG. 3. The exhaust guide plate 79 guides the exhaust gases into the balance of the exhaust system which extends downward into the lower unit to an outlet positioned proximate the propeller 58. Because the balance of the exhaust system is considered well known to those of skill in the art, such components will not be further described herein.

As will be recognized by those of skill in the art, the exhaust flow through the exhaust port 78 may be controlled by an exhaust control valve 82 such that the timing and duration of the exhaust flow from the combustion chamber 42 may be controlled as desired. The exhaust control valve 82 may be manipulated in a manner to be described below.

As those of skill in the art also will recognize, some of the exhaust gases created within the combustion chamber 42 during ignition may blow passed the piston 44 and the piston rings (not shown) either deliberately or unintentionally. These gases, referred to as blow-by gases, eventually escapes into the lubrication system rather than flowing to the atmosphere through the exhaust system.

As introduced above, the movements of the intake control valves 74 and the exhaust control valves 82 are desirably controlled such that the timing and duration of the intake and exhaust flows respectively may be controlled. With reference to FIG. 2, the illustrated exhaust control valve 82 and the illustrated intake control valve 74 are controlled by respective camshafts. Specifically, an exhaust control valve camshaft 84 preferably controls the opening and closing of the exhaust port 78 in a manner well known to those of ordinary skill in the art. Similarly, an intake control valve camshaft 86 controls the opening of the illustrated intake port 72 in a manner well known to those of ordinary skill in the art.

Both the intake camshaft 86 and the exhaust camshaft 84 are mounted for rotation with respect to the cylinder head assembly 40 and are connected thereto with at least one bracket or bearing, not shown. The camshafts 84, 86 are enclosed by camshaft covers 88 and 90, respectively. Both covers are desirably individually connected to the cylinder head assembly 40. Together, the exhaust cam cover 88, the intake cam cover 90 and a connection cover 92 combine to form a head cover 94. An area defined between the head cover 94 and the cylinder head assembly 40 is referred to herein as a cam chamber 96. Each of the camshafts 84, 86 are contained within their own cam chamber in the illustrated embodiment but need not be.

Figure 5:
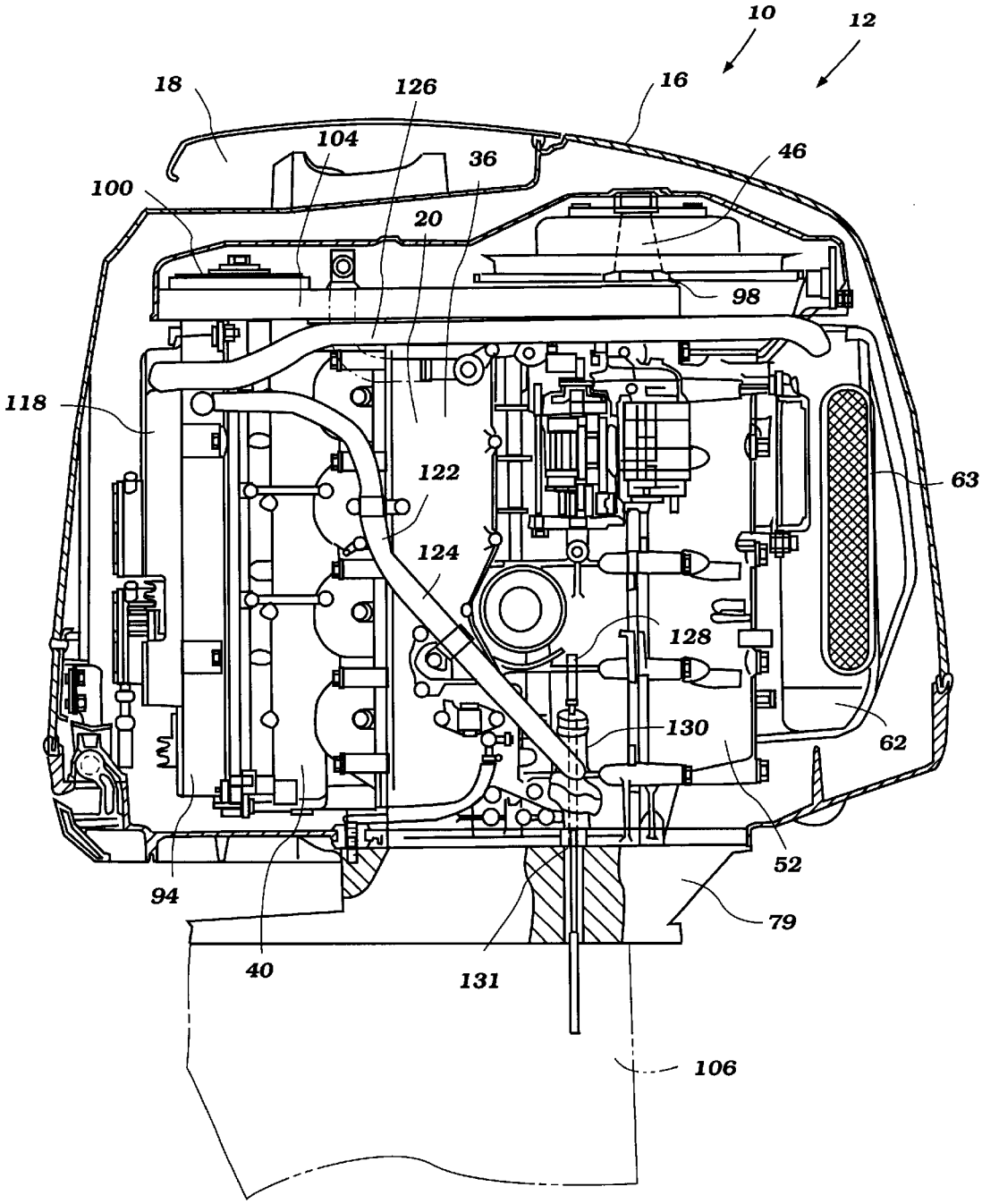
FIG. 5 is a partially-sectioned side view of a portion of the outboard motor of FIG. 1 illustrating external gas pipes configured and arranged in accordance with certain aspects of the present invention.

With reference now to FIGS. 2, 3 and 5, the exhaust camshaft 84 and the intake camshaft 86 are rotatably driven by a pulley arrangement in the illustrated embodiment. Specifically, a drive pulley 98 is mounted to one end of the crankshaft 46 such that rotation of the crankshaft 46 results in rotation of the drive pulley 98. In the illustrated embodiment, the drive pulley 98 is attached to the upper end of the crankshaft 46 as illustrated in FIG. 3. Each camshaft 84, 86 is provided with a respective driven pulley 100, 102. The relative diameters of each of the pulleys 98, 100, 102 are selected for desired performance.

A drive belt 104 loops around both driven pulleys 100, 102 and preferably has an idler pulley arranged along its length at a desirable location to maintain a tension such that as the drive pulley 98 spins, it may drive the driven pulleys 100, 102 and rotate the respective camshafts 84, 86. As the driven pulley 100 spins, the camshaft 84 rotates on bearings (not shown), thereby moving the exhaust control valve 82, which are desirably biased in an open position, through the lobe construction of the camshafts 84, 86, which construction is well known by those of ordinary skill in the art. Similarly, as the driven pulley 102 rotates, the intake camshaft 86 also drives the intake control valve 74 in a similar manner.

The present outboard motor 10 also includes a lubrication system configured and arranged in accordance with certain aspects, features and advantages of the present invention. Specifically, with initial reference to FIG. 1, the lubrication system has a lubrication pan 106 mounted within the driveshaft housing portion 24 of the lower unit 22. The lubrication pan 106 is desirably the lowest point in the lubrication system, such that the lubricant may drain from the engine components being lubricated back into the lubrication pan 106. The lubrication pan 106 may have any known size, shape or configuration and may be mounted to the engine in any suitable manner.

With reference to FIGS. 1 and 3, a lubrication pump 108 is desirably driven by either the crankshaft or the driveshaft 54, such that an auxiliary driving arrangement is not required, nor is a secondary electric motor required for those lubrication systems configured in accordance with the illustrated embodiment. As best illustrated in FIG. 3, the lubrication pump 108 is desirably mounted above the exhaust guide 79 and has an intake port extended down into the lubrication pan 106. The illustrated lubrication pump 108 preferably draws lubrication fluid from a pickup disposed within a lower portion of the lubrication pan 106 and expels it into a lubrication passage 110. As will be appreciated by those of ordinary skill in the art, the pick-up may include a filter or screening element such that debris and foreign particles may be removed prior to the lubricant being sprayed onto the moving components of the engine 20.

Figure 4:
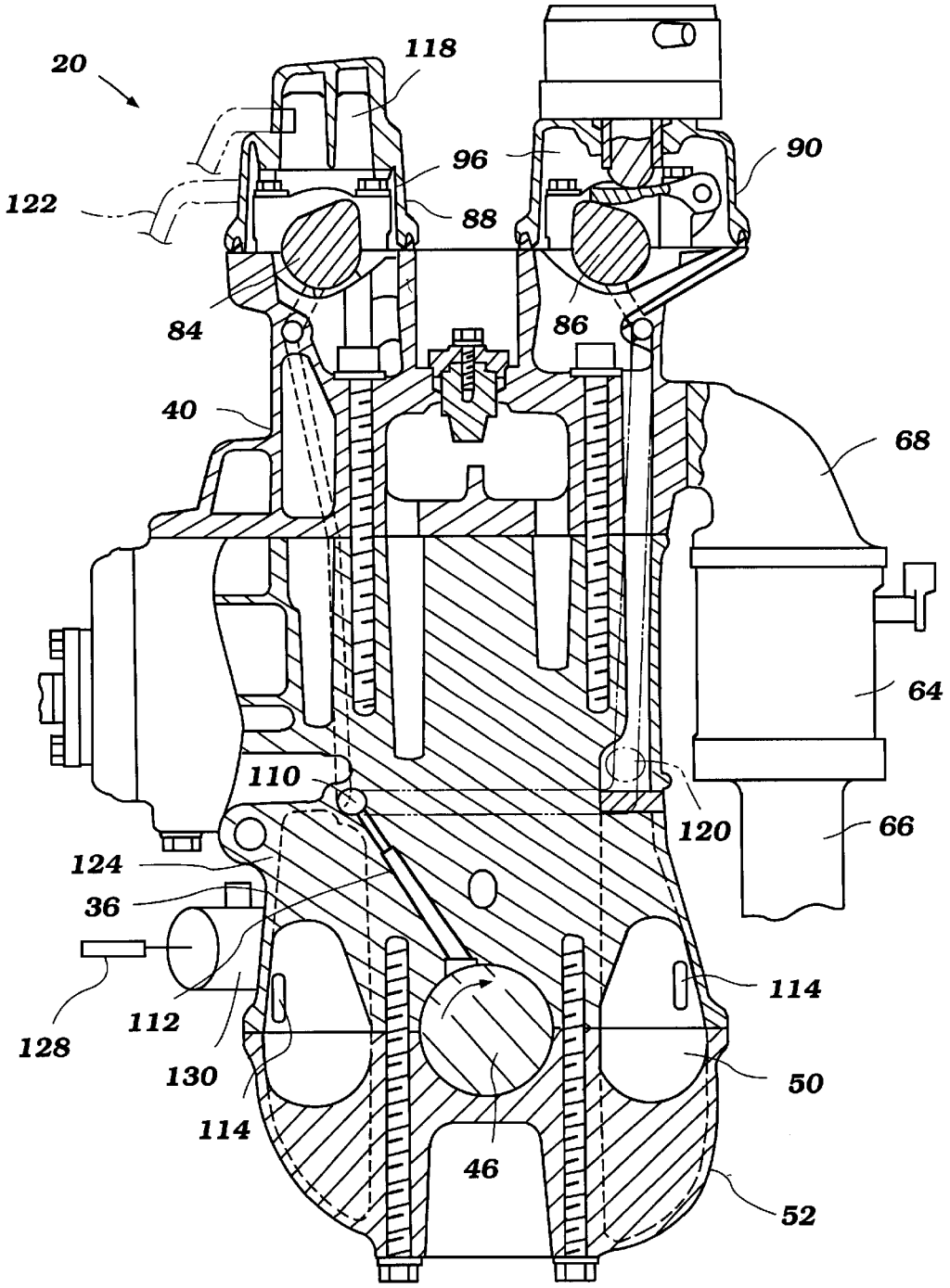
FIG. 4 is a partially-sectioned top view of the engine of FIG. 1 taken along the line 4—4.

With reference to FIG. 4, the lubrication passage 110 extends upward through the cylinder block 36 until it reaches an upper portion of the cylinder block 36. The lubrication passage 110 extends to the intake camshaft 86 and the exhaust camshaft 84 in order to supply lubrication to the camshafts respectively. The lubrication passage 110 also extends upward to connect to a crankshaft lubrication passage 112. As is known, the lubrication provided to the camshafts 84, 86 and the crankshaft 46 is expelled at various locations through secondary lubrication galleries such that the lubricant will lubricate the bearing surfaces and drain downward under the force of gravity to pool in a lower region of the crankcase chamber and camshaft chamber, respectively.

With continued reference to FIG. 4, a pair of return passages 114 are illustrated through which lubrication pooling in the lower portion of the chamber 50 may be returned to the lubrication pan 106. These return passages are best-illustrated in FIG. 3, which shows how the return passages 114 extend downward through the exhaust guide. The illustrated return passages 114 simply extend through a floor portion of the crankcase chamber 50 and empty into the lubrication pan 106.

With reference again to FIG. 3, a camshaft lubricant return passage 116 is also shown extending through the cylinder block 36. The lubricant return passage 116 has an inlet which is desirably vertically lower than the lowest control valve. In some embodiments, the lubricant return passage may have an inlet which is at approximately the same vertical position as the lower control valve 74, 82.

As described above, the illustrated lubricant pump 108 forcibly delivers lubrication through the lubrication passage 110 to an upper portion of both the intake camshaft 86 and the exhaust camshaft 84. This lubrication will be drawn downward along the camshaft within the cam chamber 96 under gravity into a pool near the bottom of the cam chamber 96. From this pooling position, the lubricant may be returned to the lubrication pan 106 through the camshaft lubrication return passage 116. As will be recognized by those of ordinary skill in the art, two lubrication return passages 116 are featured in the illustrated embodiment; however, more than two such return passageways may be utilized.

The illustrated lubrication return passages 116 feature a substantially horizontal portion having a fluted opening which is wider at its inlet and decreasing in diameter to its outlet. The outlet of the substantially horizontal portion empties into an enlarged substantially vertical portion. As shown in FIG. 3, the two portions join such that the horizontal portion is spaced vertically lower than an upper most portion of the vertical portion. Moreover, the horizontal portion has a slight downward slope to encourage downward flow when the engine is not operating. The horizontal portion is also extending in a generally forward direction. Accordingly, as the engine is tilted, flow through the passage is encouraged and, due to the slight downward slope of the horizontal portion, flow is still encouraged even when the outboard motor 10 is positioned in a slightly trimmed condition.

With reference now to FIG. 1, an oil separator 118 is provided along the camshaft chamber 96. The blow-by gases usually contain hydrocarbons and oil or lubricant particles which are picked up as the blow-by gases travel through the lubrication system. Hence, it is advantageous to have an oil separator 118 which is capable of separating the gas flow from the lubricant and thereby is capable of reducing the emission of lubricant by the engine. Moreover, such an arrangement may retard the depletion of the lubricant supply. The oil separator 118, described in more detail below, effectively strains the lubricant from the blow-by gases as they are expelled from the camshaft chambers 96.

With reference to FIG. 3, a first gas passageway 120 is defined within the cylinder block 36 and extends between the lubrication pan 106 and the cam chamber 96. As illustrated in FIG. 3, the first gas passageway 120 is separate and distinct from the camshaft lubrication return passage 116. Moreover, the first gas passageway 120 terminates within the cam chamber 96 at a location vertically higher than the inlet to the camshaft lubrication return passage 116. As illustrated, the first gas passageway 120 extends upward through the guide plate 79 into the cylinder block 36. The passageway 120 continues upward to a dogleg toward the camshaft chamber 96. The cross-sectional area of the passageway 120 is preferably approximately the same size as the upper portion of the substantially vertical component of the return passage 116. Even more preferably, the passageway 120 is larger than the smallest portion of the return passage 116. The passageway 120 also preferably opens into the chamber 96 at a position the same as or vertically higher than the lowest control valve 74, 82. While the passageway 120 may open into the chamber 96 at any position, the passageway preferably opens into the chamber below the fourth cylinder. More preferably, the passageway 120 opens into the chamber 96 below the third cylinder. In one embodiment, the passageway 120 opens into the chamber 96 between the first and second cylinders.

Figure 6:
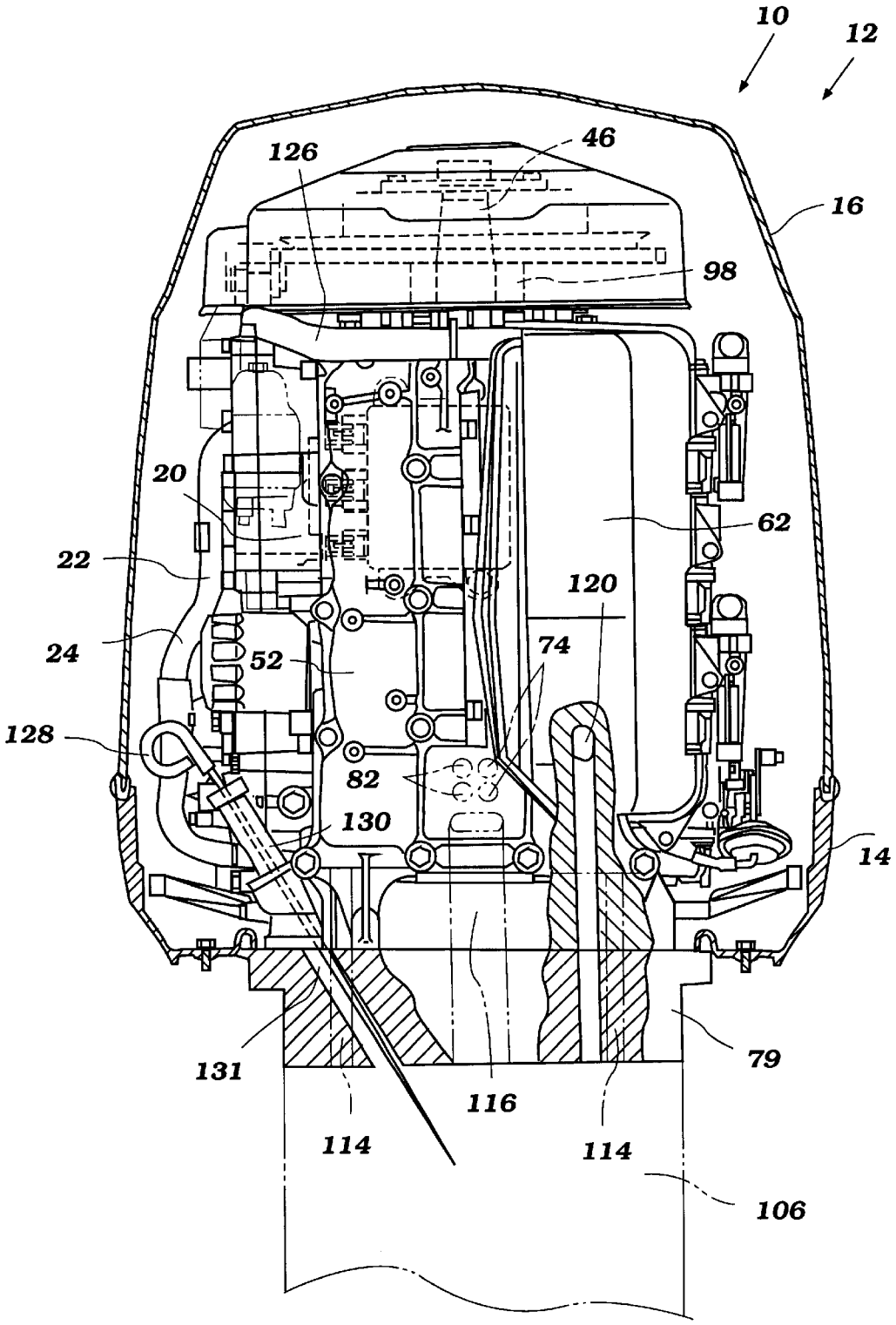
FIG. 6 is a partially-sectioned boat side view of the outboard motor of FIG. 1 illustrating the gas pipes of FIG. 5, which are configured and arranged in accordance with certain aspects of the present invention.
Figure 7:
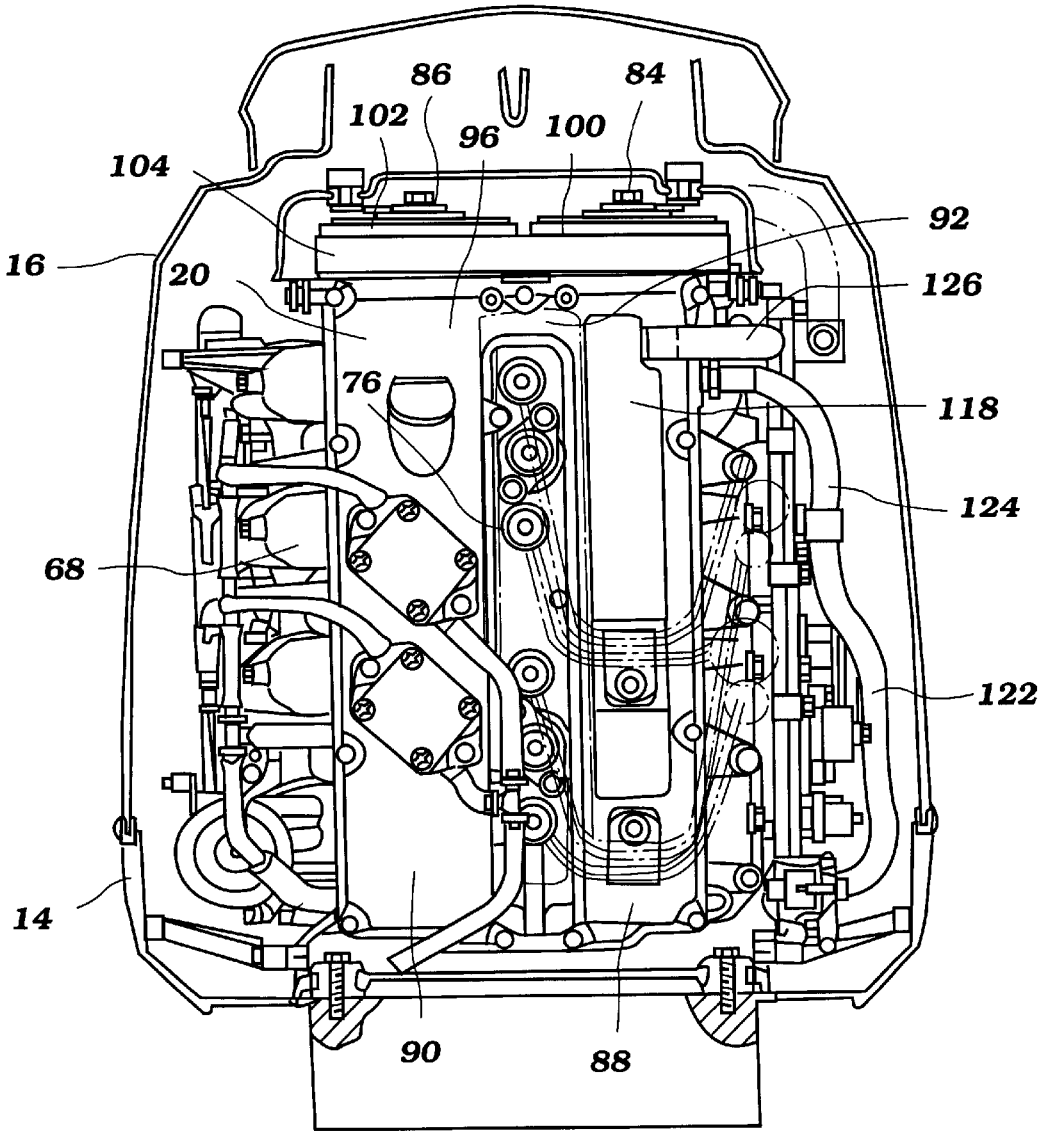
FIG. 7 is a partially-sectioned aft side view of the outboard motor of FIG. 1, further illustrating the gas pipes of FIG. 5 and a head cover arrangement configured and arranged in accordance with certain aspects of the present invention.

With reference now to FIG. 6, a second gas passageway, which is also in communication with the lubrication pan 106, extends external to the cylinder block 36 through a gas pipe 124. With reference to FIG. 2, the illustrated gas pipe 124 extends generally upward and rearward along one side of the engine 20 and transfers blow-by gases from within the lubrication pan 106 to the oil separator 118, as better illustrated in FIG. 5. The illustrated gas pipe 124 includes a substantially vertically extending portion such that some of the entrained lubricant may return downward through the gas pipe 124 back into the lubricant reservoir 106. The gas pipe 124 extends upwardly and rearwardly towards the head cover 94 and the oil separator 118, whereby any lubrication particles being transferred therewith can be separated out by the force of gravity such that they may drain back into the lubrication pan 106.

The blow-by gases are then removed from the oil separator 118 via a second gas pipe or breather pipe 126. As best illustrated in FIG. 5, the second gas pipe 126 extends between an upper portion of the oil separator 118 and an upper portion of the air intake silencer 62. In this manner, the blow-by gases being siphoned from the oil separator 118 likely have the greatest amount of lubricant removed therefrom due to the suctioned removal from an uppermost portion of the oil separator. As will be recognized by those of skill in the art, the lower portion of the oil separator may be connected to the lubrication pan 106 using any suitable passage. The blow-by gases transferred through the gas pipe 126 into the induction silencer 62 may then be recycled back through the intake system 60 for recombustion when combined with fresh air and fuel charges.

With reference to FIGS. 2, 4 and 6, the present lubrication system is also provided with a ullage rod 128 which extends through a cylindrical tubular member 130 and an internal passageway 131 such that a portion of the ullage rod 128 is received within the lubrication pan 106. This arrangement is best illustrated in FIG. 5. In this manner, the ullage rod 128 may be withdrawn from the tubular member 130 and passageway 131 to identify whether a lubrication level within the lubrication pan 106 has decreased to a level indicating that the lubricant needs to be replenished. Additionally, this ullage rod 128 allows periodic confirmation that the lubricant is not being depleted due to the effects of the blow-by gases on the lubrication system. Notably, the tubular member 130 is positioned near the first end of the second gas passageway 122 (i.e., the first gas pipe 124) such that the second gas passageway 122 may be coupled to the tubular member 130 to allow the gases present within the lubrication pan to escape therethrough into the first gas passageway.

Thus, the lubrication system configured and arranged in accordance with certain aspects, advantages and features of the present invention allows the removal of the blow-by gases from within the lubrication system without substantially affecting the flow of the lubricant back into the lubrication pan 106. Therefore, the likelihood of flooding of the camshaft chamber 96 by lubricant due to blow-by gases impeding the exit flow of lubricant from the chamber 96 is decreased. Additionally, the use of the oil separator and the external flow lines allows the size of the engine to be reduced by a corresponding reduction in the size of the cylinder block 36. As will be appreciated, the reduction in the size of the cylinder block also accompanies a reduction in the weight of the outboard motor overall.

Although the present invention has been described in terms of a certain embodiment, other embodiments apparent to those of ordinary skill in the art also are within the scope of this invention. Thus, various changes and modifications may be made without departing from the spirit and scope of the present invention. Moreover, not all the features, aspects and advantages are necessarily required to practice the present invention. Accordingly, the scope of the present invention is intended to be defined only by the claims that follow.

What is claimed is:

1. An outboard motor comprising a four-cycle engine having an engine body which includes at least a cylinder block and a cylinder head assembly connected to the cylinder block, the cylinder block having at least one cylinder, the cylinder having a substantially horizontal axis, a piston arranged for reciprocation within the cylinder and connected to an output shaft, the output shaft having a substantially vertical axis, at least one combustion chamber defined between the head assembly and a piston, at least one intake port and at least one exhaust port communicating with the combustion chamber, an intake valve capable of closing and opening the intake port, an exhaust valve capable of closing and opening the exhaust port, an intake cam shaft capable of moving the intake valve, an exhaust cam shaft capable of moving the exhaust valve, a head cover positioned over the intake cam shaft and the exhaust cam shaft and defining, in part, a cam chamber, a lubrication reservoir arranged generally below a lower end of the cylinder block, a lubricant return passageway extending between the cam chamber and the lubrication reservoir, a gas passageway connecting the lubrication reservoir and the cam chamber, wherein at least a portion of the gas passageway includes a gas pipe positioned external to the engine body, and not cast monolithically therewith.

2. The outboard motor as set forth in claim 1 further comprising a removable ullage rod extending through a passageway into the lubricant reservoir, wherein the gas passageway is connected to the lubricant reservoir through the passageway through which the ullage rod extends.

3. The outboard motor as set forth in claim 2, wherein the passageway through which the ullage rod extends, includes a portion external to the engine and wherein the gas passageway is connected to the external portion of the passageway.

4. The outboard motor as set forth in claim 1 further comprising an oil separator, wherein the gas passageway includes a path through the oil separator.

5. The outboard motor as set forth in claim 4, wherein the gas pipe is connected to an upper portion of the oil separator.

6. The outboard motor as set forth in claim 5, wherein the gas pipe has a substantially vertical portion.

7. The outboard motor as set forth in claim 5 further comprising a breather pipe and an induction system, wherein the breather pipe extends between the oil separator and the induction system.

8. The outboard motor as set forth in claim 7, wherein the breather pipe is connected to a silencer of the induction system.

9. The outboard motor as set forth in claim 7, wherein the breather pipe is connected to the oil separator at a location vertically higher than a location at which the gas pipe is connected to the oil separator.

10. The outboard motor as set forth in claim 1, wherein the lubricant return passageway has an opening positioned within the cam chamber at a location vertically lower than a lowermost cylinder axis.

11. An outboard motor comprising an engine having an engine body comprising a cylinder block and a cylinder head assembly, the engine further comprising a generally vertically-oriented camshaft, the camshaft contained within a camshaft chamber, the engine also having a lubricant reservoir, a lubricant pump arranged to pump lubricant from the lubricant reservoir to at least one location proximate the camshaft, a lubricant return passage extending between a lower portion of the camshaft chamber and the lubricant reservoir, a gas passage extending between the lubricant reservoir and the camshaft chamber, the gas passage entering the camshaft chamber at a location that is vertically higher than an opening in the camshaft chamber leading to the lubricant return passage and at least a portion of the gas passage being positioned external to the engine body, and not cast monolithically therewith.

12. The outboard motor as set forth in claim 11, wherein the engine further comprises at least three cylinders each having a substantially horizontally-extending axis.

13. The outboard motor as set forth in claim 12, wherein the opening in the camshaft chamber leading to the lubricant return passage is arranged vertically lower than the axis of a lowermost cylinder of the at least three cylinders.

14. The outboard motor as set forth in claim 12, wherein the entry of the gas passage into the camshaft chamber is positioned vertically higher than at least the lowermost two cylinders of the at least three cylinders.

15. The outboard motor as set forth in claim 11 further comprising an oil separator, wherein the gas passage includes a path extending through the oil separator.

16. An outboard motor comprising an engine, the engine comprising a generally vertically-oriented camshaft, the camshaft contained within a camshaft chamber, the engine also having a lubricant reservoir, a lubricant pump arranged to pump lubricant from the lubricant reservoir to at least one location proximate the camshaft, a lubricant return passage extending between a lower portion of the camshaft chamber and the lubricant reservoir, a gas passage extending between the lubricant reservoir and the camshaft chamber, the gas passage entering the camshaft chamber at a location that is vertically higher than an opening in the camshaft chamber leading to the lubricant return passage and at least a portion of the gas passage being positioned external to the engine, and a tube sized and configured to accept a ullage rod, the tube being connected to the lubricant reservoir, wherein the gas passage includes a path extending through at least a portion of the tube.

17. The outboard motor as set forth in claim 15 further comprising an induction system, the induction system having an air collection chamber, wherein the oil separator is connected to the air collection chamber such that the induction system siphons air flow from within the oil separator.

18. An outboard motor comprising an engine and a lubrication reservoir disposed generally below the engine, the engine comprising an engine body including a cylinder block defining at least one cylinder bore, a piston reciprocating within the cylinder bore, a cylinder head assembly closing one end of the cylinder bore and defining a combustion chamber with the cylinder bore and the piston, the engine further comprising an air induction system arranged to supply air to the combustion chamber, at least one intake valve selectively opening and closing the air induction system to the combustion chamber, an actuation mechanism arranged to actuate the intake valve, the actuation mechanism being disposed within a chamber of the engine, a lubrication system arranged to lubricate at least the actuation mechanism, a lubricant return passage extending between the actuation chamber and the lubrication reservoir, a lubricant separator arranged to separate gases from the lubricant, a first gas passage extending between the lubrication reservoir and the lubricant separator, the first gas passage including a gas pipe positioned externally of the engine body and not cast monolithically therewith, and a second gas passage extending between the lubricant separator and the air induction system.

19. An outboard motor comprising an engine and a lubrication reservoir disposed generally below the engine, the engine comprising a cylinder block defining at least one cylinder bore, a piston reciprocating within the cylinder bore, a cylinder head assembly closing one end of the cylinder bore and defining a combustion chamber with the cylinder bore and the piston, an air induction system arranged to supply air to the combustion chamber, at least one intake valve selectively opening and closing the air induction system to the combustion chamber, an actuation mechanism arranged to actuate the intake valve, the actuation mechanism being disposed within a chamber of the engine, a lubrication system arranged to lubricate at least the actuation mechanism, a lubricant return passage extending between the actuation chamber and the lubrication reservoir, a lubricant separator arranged to separate gases from the lubricant, a first gas passage extending between the lubrication reservoir and the lubricant separator, the first gas passage including a gas pipe positioned externally of the cylinder block, a second gas passage extending between the lubricant separator and the air induction system, and a ullage rod detachably extending through a rod passageway, the rod passageway leading from external port of the engine toward the lubricant reservoir, and the first gas passage includes the rod passageway as part thereof.

* * * * *